US008447201B2

(12) United States Patent
Aoki et al.

(10) Patent No.: US 8,447,201 B2
(45) Date of Patent: May 21, 2013

(54) IMAGE FORMING APPARATUS FOR CONTROLLING IMAGE DENSITY

(75) Inventors: Matsuyuki Aoki, Kanagawa (JP); Shigeru Tsukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 857 days.

(21) Appl. No.: 12/547,895

(22) Filed: Aug. 26, 2009

(65) Prior Publication Data

US 2010/0247124 A1 Sep. 30, 2010

(30) Foreign Application Priority Data

Mar. 27, 2009 (JP) ..... P2009-079609

(51) Int. Cl.
*G03G 15/00* (2006.01)

(52) U.S. Cl.
USPC ..... 399/72; 358/1.9

(58) Field of Classification Search
USPC ..... 399/72
See application file for complete search history.

(56) References Cited

U.S. PATENT DOCUMENTS

| | | | | |
|---|---|---|---|---|
| 4,980,723 | A * | 12/1990 | Buddendeck et al. | 399/72 |
| 6,823,158 | B2 * | 11/2004 | Yamada et al. | 399/179 |
| 8,248,640 | B2 * | 8/2012 | Tanaka et al. | 358/1.15 |
| 8,311,426 | B2 * | 11/2012 | Shishikura et al. | 399/49 |
| 2004/0096231 | A1 * | 5/2004 | Furno et al. | 399/49 |
| 2005/0052488 | A1 * | 3/2005 | Inoue | 347/19 |
| 2007/0053727 | A1 * | 3/2007 | Goto | 399/301 |
| 2008/0019740 | A1 * | 1/2008 | Oouchi | 399/301 |
| 2008/0107434 | A1 * | 5/2008 | Toyohara | 399/62 |
| 2009/0003893 | A1 * | 1/2009 | Nishikawa et al. | 399/301 |
| 2010/0221024 | A1 * | 9/2010 | Funayama et al. | 399/46 |
| 2010/0329722 | A1 * | 12/2010 | Funayama et al. | 399/72 |
| 2012/0308246 | A1 * | 12/2012 | Okamoto | 399/49 |

FOREIGN PATENT DOCUMENTS

| | | | |
|---|---|---|---|
| JP | 8-76530 | | 3/1996 |
| JP | 2000-227693 | | 8/2000 |
| JP | 2007163996 | A * | 6/2007 |
| JP | 2010091806 | A * | 4/2010 |
| JP | 2011008030 | A * | 1/2011 |
| JP | 2011227316 | A * | 11/2011 |

* cited by examiner

*Primary Examiner* — David Gray
*Assistant Examiner* — Geoffrey Evans
(74) *Attorney, Agent, or Firm* — Sughrue Mion, PLLC

(57) ABSTRACT

An image forming apparatus includes plural image holding members; an intermediate transfer material; a transfer unit that transfers the toner images onto a recording medium; a density control toner image creating unit that creates a density control toner image at a constant position on each of the image holding members; a density detection unit that detects density of the density control toner image transferred onto a non-image region; and a creation timing control unit that controls timing of creating the density control toner image to create the density control toner image in the non-image region of the intermediate transfer material at a position where a length obtained by integrally multiplying the length obtained by adding the non-image region to the image region along the moving direction of the intermediate transfer material becomes equal to a length obtained by integrally multiplying the circumferential length of the image holding member.

5 Claims, 10 Drawing Sheets

FIG. 8

| SIZE OF SHEET (mm) | | PITCH | PANEL LENGTH (mm) | OUTSIDE (GAP) AREA OF STANDARD IMAGE (mm) | |
|---|---|---|---|---|---|
| MIN | MAX | [DRUM CYCLE] | | MAX | MIN |
| 182.0 | 216.0 | 1.00 | 264.0 | 82.0 | 48.0 |
| 216.1 | 280.0 | 1.25 | 330.0 | 113.9 | 50.0 |
| 280.1 | 340.0 | 1.50 | 396.0 | 115.9 | 56.0 |
| 340.1 | 482.6 | 2.00 | 528.0 | 187.9 | 45.4 |
| 482.7 | 488.0 | 2.50 | 660.0 | 177.3 | 172.0 |

IMAGE FORMING APPARATUS FOR CONTROLLING IMAGE DENSITY

CROSS-REFERENCE TO RELATED APPLICATIONS

This application is based on and claims priority under 35 USC 119 from Japanese Patent Application No. 2009-079609 filed on Mar. 27, 2009.

BACKGROUND

1. Technical Field

The invention relates to an image forming apparatus.

2. Related Art

In related art, as for the image forming apparatus, there is known, for example, an image forming apparatus having four image forming parts corresponding to respective colors of yellow, magenta, cyan and black, where respective toner images of yellow, magenta, cyan and black are sequentially formed on the photoreceptor drums of those four image forming parts, the toner images of respective colors formed on these photoreceptor drums are primarily transferred in a superposed manner onto an intermediate transfer belt, and the toner images of respective colors are en bloc secondarily transferred onto a recording sheet from the intermediate transfer belt and at the same time, fixed thereon to form a color image.

For controlling the image density in each image forming part of yellow, magenta, cyan or black, the image forming apparatus above is configured such that a patch by a density detection toner image is formed on the photoreceptor drum in each image forming part, the density detection patch formed on each photoreceptor drum is transferred onto an intermediate transfer belt, the density of the density detection patch transferred onto the intermediate transfer belt is detected by a density detection unit, and the image density in each image forming part is controlled according to the detection results of the density detection unit.

In the image forming apparatus above, at the time of forming an image detection patch on the photoreceptor drum in each image forming part of yellow, magenta, cyan or black, when the formation position for the density detection patch in the circumferential direction on the photoreceptor drum is fluctuated, the variation or the like of photosensitive characteristics along the circumferential direction of the photoreceptor drum sometimes affects the density.

Accordingly, in the related-art image forming apparatus, the formation position for the density detection patch on the photoreceptor drum is set to always become the same position, and the density detection patch formed at the same position on the photoreceptor drum is transferred onto the intermediate transfer belt and detected with an attempt to realize the stability of image density and each color.

SUMMARY

According to an aspect of the invention, there is provided an image forming apparatus including:

plural image holding members on which toner images of colors different from each other are formed;

an intermediate transfer material onto which the toner images of respective colors formed on the plural image holding members are transferred;

a transfer unit that transfers the toner images of respective colors transferred on the intermediate transfer material, onto a recording medium;

a density control toner image creating unit that creates a density control toner image at a constant position on each of the image holding members;

a density detection unit that detects density of the density control toner image formed on each of the image holding members by the density control toner image creating unit and then transferred onto a non-image region defined between adjacent image regions along a moving direction of the intermediate transfer material, a length obtained by adding the non-image region to the image region along the moving direction of the intermediate transfer material being different from a length obtained by integrally multiplying a circumferential length of the image holding member; and a creation timing control unit that controls timing of creating the density control toner image to create the density control toner image in the non-image region of the intermediate transfer material at a position where a length obtained by integrally multiplying the length obtained by adding the non-image region to the image region along the moving direction of the intermediate transfer material becomes equal to a length obtained by integrally multiplying the circumferential length of the image holding member.

BRIEF DESCRIPTION OF THE DRAWINGS

Exemplary embodiments of the invention will be described in detail based on the following figures, wherein:

FIG. 8 is a table showing sizes of an image area and a non-image area on an intermediate transfer belt;

DETAILED DESCRIPTION

Figure 1:
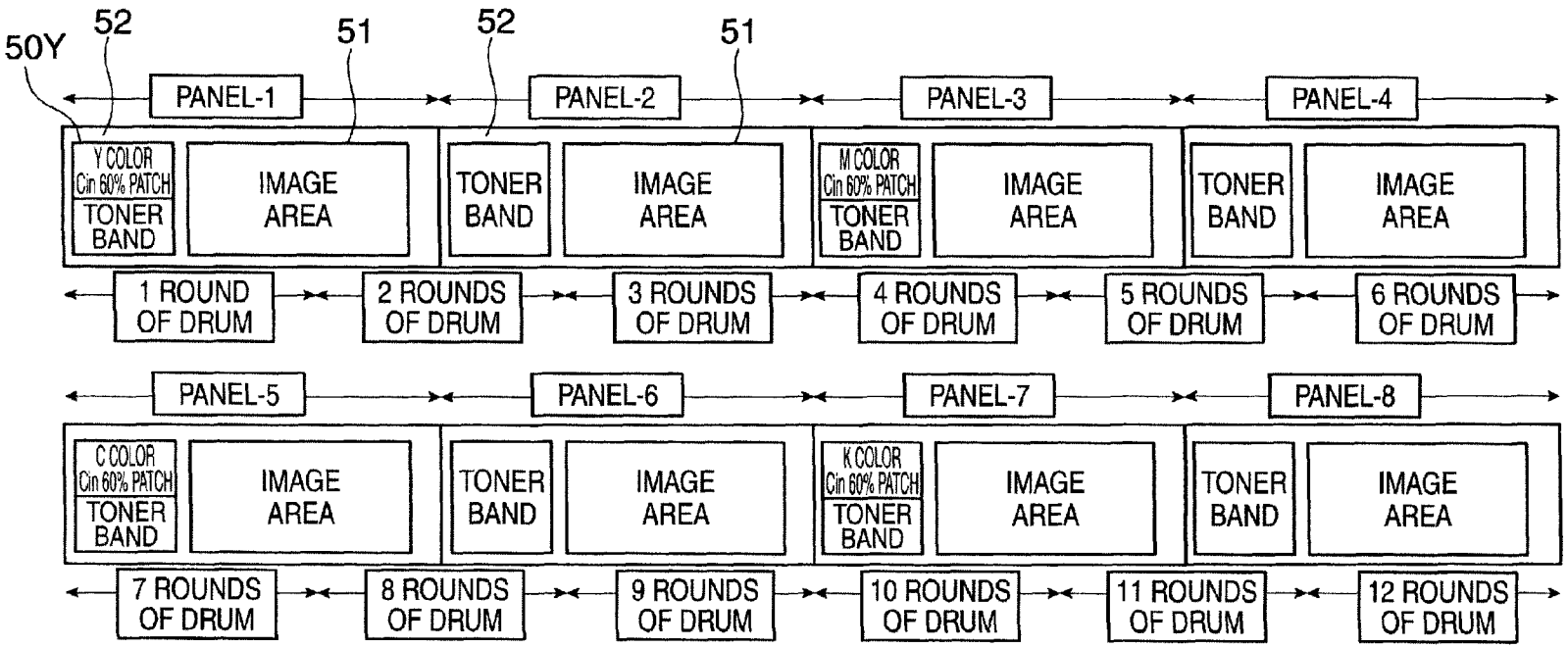
FIG. 1 is a configuration diagram showing locations of an image area and a non-image area of a tandem-type full color printer as the image forming apparatus according to an exemplary embodiment 1 of the invention.

The mode for carrying out exemplary embodiments of the invention is described below by referring to the drawings.

Exemplary Embodiment 1

Figure 2:
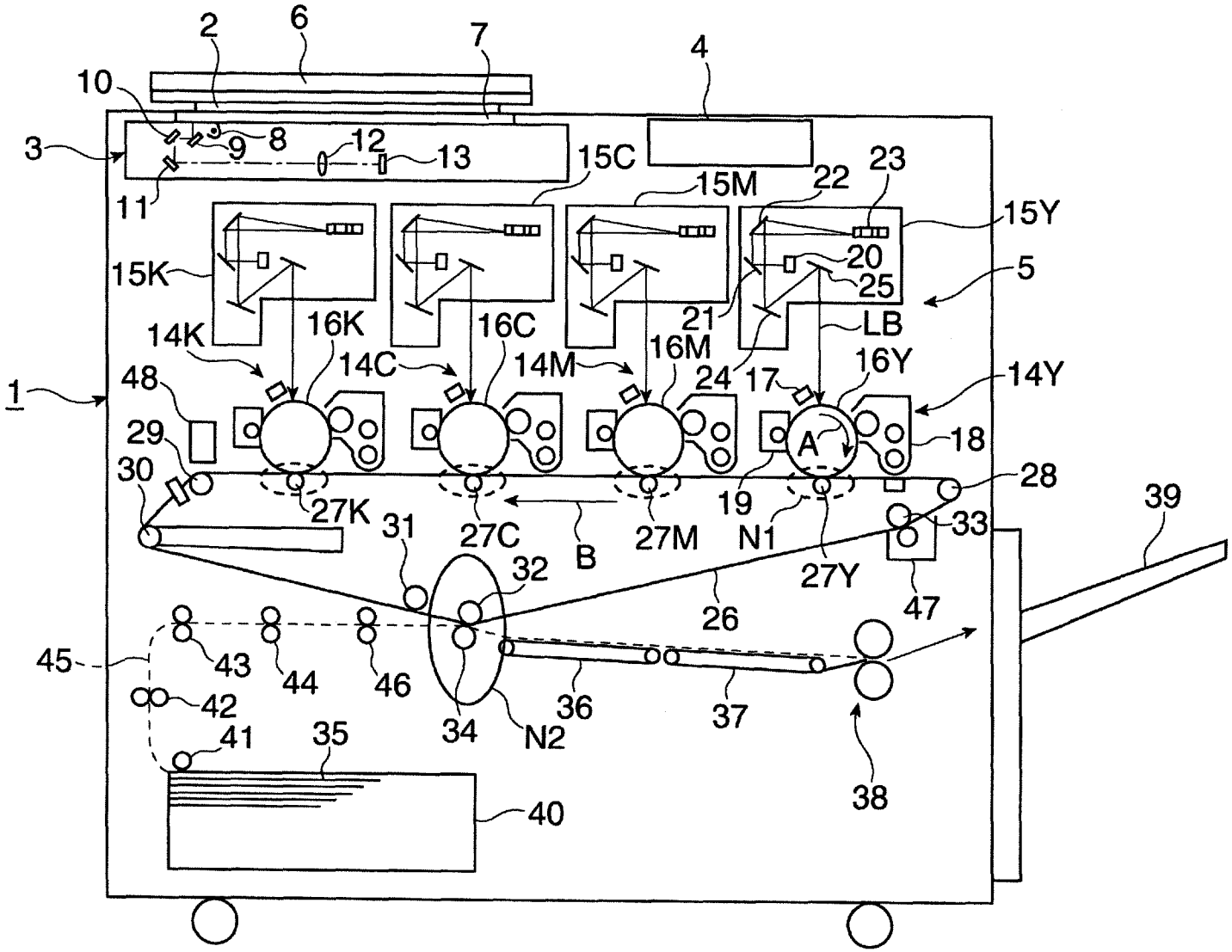
FIG. 2 is a configuration diagram showing a tandem-type full color printer as the image forming apparatus according to the exemplary embodiment 1 of the invention.

FIG. 2 is a schematic configuration diagram showing a tandem-type digital color printer as the image forming apparatus according to an exemplary embodiment 1 of the invention. This tandem-type digital color printer is equipped with an image reading device and designed to function also as a full color copying machine or a facsimile. Incidentally, the image forming apparatus may be of course an image forming apparatus not equipped with an image reading device but designed to form an image based on image data output from a personal computer or the like (not shown).

In FIG. 2, 1 indicates the body of the tandem-type digital color printer, and the digital color printer body 1 is equipped with an image reading device 3 for reading an image of an original 2, in the upper part on one side (in the Figure, on the left side). In the inside of the color printer body 1, an image processing device 4 for applying predetermined image processing to the image data output from the image reading device 3 or a personal computer or the like (not shown) or the image data sent via a telephone line, LAN or the like is disposed. Further, in the inside of the digital color printer body 1, an image output device 5 for outputting an image based on the image data subjected to the predetermined image processing by the image processing device 4 is disposed.

The image reading device 3 is configured such that an original 2 is placed on a platen glass 7 by opening a platen cover 6 and while the original 2 placed on the platen glass 7 is illuminated by a light source 8, the reflected light image from the original 2 is exposed and scanned on an image reading element 13 composed of CCD or the like through a size-reduction scanning optical system composed of a full rate mirror 9, half rate mirrors 10 and 11 and an imaging lens 12 so that the image of the original 2 can be read at a predetermined dot density by the image reading element 13.

The image of the original 2 read by the image reading device 3 is sent as original reflectance data of, for example, three colors of red (R), green (G) and blue (B) (for example, 8 bits for each color) to the image processing device 4. In the image processing device 4, predetermined image processing such as shading correction, misregistration correction, brightness/color-space conversion, gamma correction, frame cancellation and color/moving edition is applied to the reflectance data of the original 2.

The image data subjected to the predetermined image processing by the image processing device 4 as above are converted into four-color image data of yellow (Y), magenta (M), cyan (C) and black (K) by the same image processing device 4, and the thus-converted data are sent to image exposure devices 15Y, 15M, 15C and 15K in image forming units 14Y, 14M, 14C and 14K of respective colors of yellow (Y), magenta (M), cyan (C) and black (K). In these image exposure devices 15Y, 15M, 15C and 15K, image exposure with laser light is performed in accordance with the image data of the corresponding color.

In the inside of the tandem-type digital color printer body 1 above, as described above, four image forming units 14Y, 14M, 14C and 14K of yellow (Y), magenta (M), cyan (C) and black (K) are arranged in parallel at regular intervals in the horizontal direction.

These four image forming units 14Y, 14M, 14C and 14K all are, as shown in FIG. 2, configured in the same manner except for the color of the image formed and, roughly, each includes a photoreceptor drum 16 serving as an image holding member and being rotationally driven at a predetermined rate along the arrow A direction, a primary charger scorotron 17 (or charging roll) for uniformly charging the surface of the photoreceptor drum 16, an image exposure device 15 as an image writing unit for applying image exposure to the photoreceptor drum 16 surface based on the image data corresponding to each color to form an electrostatic latent image, a developing device 18 for developing the electrostatic latent image formed on the photoreceptor drum 16 with a toner, and a cleaning device 19 for cleaning the toner and the like remaining on the photoreceptor drum 16 surface.

In the image exposure device 15, as shown in FIG. 2, a semiconductor laser 20 is modulated in accordance with the image date of the corresponding color output from the image processing device 4, and laser light LB is output from the semiconductor laser 20 in accordance with the image data. The laser light LB output from the semiconductor laser 20 is irradiated on the surface of a rotating polygon mirror 23 through mirrors 21 and 22 and after deflection scanning by the rotating polygon mirror 23, scanned and exposed on the photoreceptor drum 16 along its rotation axis direction (main scanning direction) through an f-θ lens (not shown), reflector mirrors 22, 24 and 25 and the like.

As shown in FIG. 2, the image processing device 4 sequentially outputs the image data of the corresponding color to the image exposure devices 15Y, 15M, 15C and 15K in the image forming units 14Y, 14M, 14C and 14K of respective colors of yellow (Y), magenta (M), cyan (C) and black (K), these image exposure devices 15Y, 15M, 15C and 15K each outputs laser light LB in accordance with the image data, and the laser light is exposed and scanned on the surface of the corresponding photoreceptor drum 16Y, 16M, 16C or 16K to form an electrostatic latent image. The electrostatic latent images formed on the surfaces of the photoreceptor drums 16Y, 16M, 16C and 16K are developed as color toner images of yellow (Y), magenta (M), cyan (C) and black (K) by developing devices 18Y, 18M, 18C and 18K, respectively.

The color toner images of yellow (Y), magenta (M), cyan (C) and black (K) sequentially formed on the photoreceptor drums 16Y, 16M, 16C and 16K in the image forming units 14Y, 14M, 14C and 14K are, as shown in FIG. 2, transferred in a superposed manner onto an intermediate transfer belt 26 that is an endless belt-like intermediate transfer material disposed below the image forming units 14Y, 14M, 14C and 14K, by primary transfer rolls 27Y, 27M, 27C and 27K at primary transfer positions N1. The intermediate transfer belt 26 is hung over a drive roll 28, a tension roll 29, a meander control roll 30, a driven roll 31, a backup roll 32 and a driven roll 33 and is circularly driven at a predetermined moving rate along the arrow B direction by the drive roll 28 that is rotationally driven by an exclusive drive motor (not shown) excellent in the constant rate property. The intermediate transfer belt 26 used is, for example, an endless belt that is obtained by forming a flexible synthetic resin film such as polyimide or polyamideimide into a belt-like shape and connecting both ends of the belt-shaped synthetic resin film by welding or the like, or by forming the belt in an endless shape from the start.

The color toner images of yellow (Y), magenta (M), cyan (C) and black (K) transferred in a superposed manner on the intermediate transfer belt 26 are, for example, applied with a transfer voltage having polarity (positive polarity) reverse to the toner by a backup roll 32 and at the same time, secondarily transferred onto a recording sheet 35 that is a recording medium, at a secondary transfer position N2 under pressure-contact force and electrostatic force by an earth-grounded secondary transfer roll 34 in pressure-contact with the backup roll 32. The recording sheet 35 where toner images according to the colors of an image to be formed are transferred is conveyed to a fixing device 38 by two continued conveying belts 36 and 37. The recording sheet 35 where toner images of respective colors are transferred is subjected to a fixing treatment under heat and pressure by the fixing device 38 and then discharged on a discharge tray 39 provided in the outside of the printer body 1.

The recording sheet 35 that is in a desired size and formed of a desired material is, as shown in FIG. 2, fed in a state of being separated sheet by sheet by means of a sheet feed roll 41 and a pair of sheet separation rolls (not shown) from a sheet feed tray 40 provided in the bottom of the printer body 1 and once conveyed to a resist roll 46 through a sheet conveying path 45 where plural conveying rolls 42, 43 and 44 are disposed. The recording sheet 35 fed from the sheet feed tray 40 is delivered to the secondary transfer position N2 of the intermediate transfer belt 26 by the resist roll 46 that is rotationally driven at a predetermined timing. Here, only one sheet feed tray 40 is illustrated, but plural sheet feed trays containing recording sheets 35 differing from or same with each other in the size may be provided, and a large number of recording sheets 35 are allowed to be continuously fed from the sheet feed tray 40.

In advance, in the four image forming units 14Y, 14M, 14C and 14K of yellow color, magenta color, cyan color and black color, as described above, toner images of yellow color, magenta color, cyan color and black color are formed in sequence at a predetermined timing.

After the toner image transfer step is completed, a residual toner and the like are removed by cleaning devices 19Y, 19M, 19C and 19K, and the photoreceptor drums 16Y, 16M, 16C and 16K are prepared for the next image forming process. Also, a residual toner, paper dusts and the like on the intermediate transfer belt 26 are removed by a belt cleaner 47 disposed to oppose the driven roll 33.

In the thus-configured digital color printer, as described later, image density control toner images (hereinafter sometimes referred to as a "density control patch") 50Y, 50M, 50C and 50K are formed on the photoreceptor drum 16, the density control patch 50Y, 50M, 50C or 50K is, as shown in FIG. 1, transferred onto a non-image region 52 defined by a gap located between an image area 51 and an image area 51 of the intermediate transfer belt 26, which are later transferred onto a recording sheet 35, the density of each of the density control patches 50Y, 50M, 50C and 50K transferred onto the intermediate transfer belt 26 is detected by a density sensor 48 that is a density detection unit disposed, as shown in FIG. 2, downstream of the black image forming unit 14K in the moving direction of the intermediate transfer belt.

The density control patches 50Y, 50M, 50C and 50K are, as shown in FIG. 1, formed in the non-image region 52 of the intermediate transfer belt 26, for example, with two kinds of densities of Cin=60% and Cin=20% for each of the colors of yellow, magenta, cyan and black at predetermined intervals along the moving direction of the intermediate transfer belt 26 or formed in parallel in the non-image region 52 of the intermediate transfer belt 26 at predetermined intervals in the direction crossing the moving direction of the intermediate transfer belt 26.

Figure 3:
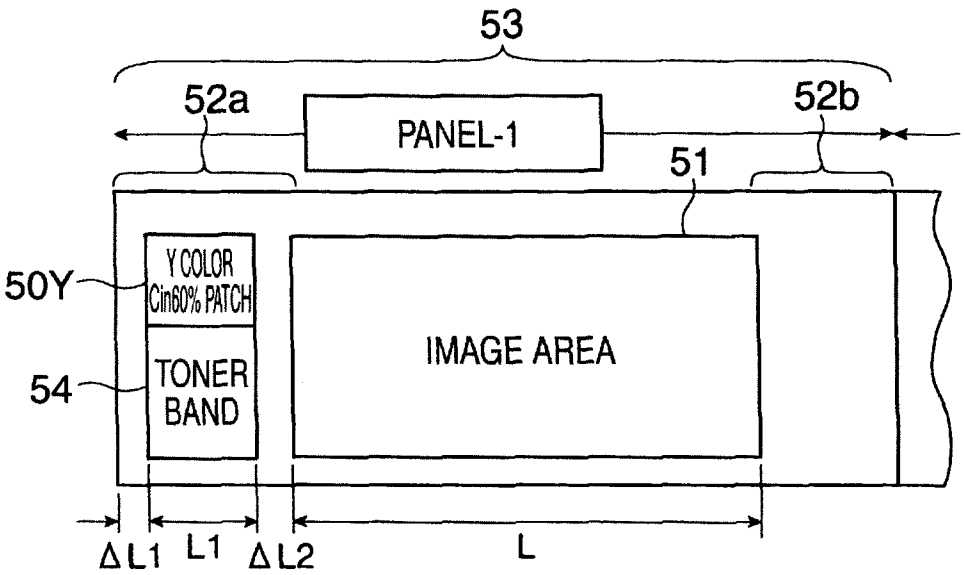
FIG. 3 is a configuration diagram showing locations of an image area and a non-image area on an intermediate transfer belt.

More specifically, as shown in FIG. 3, in the case where recording sheets 35 of the same size are continuously conveyed, the surface of the intermediate transfer belt 26 is divided into plural panels 53 having a length according to the size of the recording sheet 35 (the size along the moving direction of the intermediate transfer belt 26).

One panel 53 defined on the intermediate transfer belt 26 surface is composed of an image area 51 corresponding to the size of the recording sheet 35 along the moving direction of the intermediate transfer belt 26, and non-image areas (non-image regions) 52 defined before and after the image area 51. The size of the image area 51 is determined in correspondence with the length L of the recording sheet 35 along the moving direction of the intermediate transfer belt 26. As for a non-image area 52*a* located upstream of the image area 51 in the moving direction of the intermediate transfer belt 26, its minimum size is previously determined by the size or the like of the density control patch 50.

Figure 4:
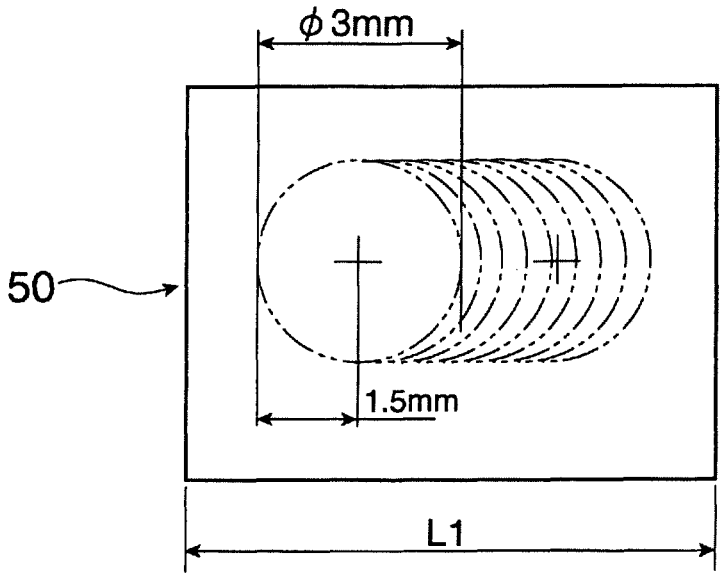
FIG. 4 is a schematic view showing a density control toner image.

The shape of the density control patch 50 is, as shown in FIGS. 3 and 4, set to be planar and rectangular and at the time of detecting the density of the density control patch 50 by the density sensor 48, plural points (for example, about 15 points) on the surface of the density control patch 50 are sampled at predetermined time intervals ΔT by using circular light emission of about 3 mm in diameter of the density sensor 48 and averaged, whereby the density of the density control patch 50 is detected.

Accordingly, the density control patch 50 is required, as shown in FIG. 4, to have a certain amount of length L1 along the moving direction of the intermediate transfer belt 26. After the density is detected by the density sensor 48, the density control patch 50 formed on the intermediate transfer belt 26, as shown in FIG. 2, passes the secondary transfer position and is removed from the intermediate transfer belt 26 by the cleaning device 47. In order to prevent the toner constituting the density control patch 50 from adhering to the surface of the secondary transfer roll 34 at the time of the density control patch 50 passing the secondary transfer position, the transfer bias voltage applied to the secondary transfer roll 34 or the backup roll 32 is switched to the polarity that prevents adhesion of the density control patch 50, but the time necessary for switching of the polarity of the bias voltage needs to be taken into consideration.

In this respect, the size of the non-image area 52*a* in the panel 53 defined on the intermediate transfer belt 26 surface is, as shown in FIG. 3, set to a value obtained by adding on the length L1 of the density control patch 50 to the lengths ΔL1 and ΔL2 (for example, ΔL1=ΔL2) each corresponding to the time required to switch the polarity of the transfer bias power source.

In the direction of the density control patch 50 crossing the moving direction of the intermediate transfer belt 26, as shown in FIG. 3, a rectangular toner band 54 is formed, if desired. The toner band 54 is not an essential element and is formed, if desired, for adjusting the toner concentration in the developer inside of the developing device of each image forming unit or supplying the toner to the cleaning device 19 of each of the image forming units 14Y, 14M, 14C and 14K so as to avoid excessive abrasion or the like of a blade (not shown) of the cleaning device 19.

Figure 5:
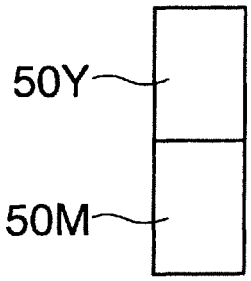
FIG. 5 is a schematic view showing another example of the density control toner image.

Incidentally, the density control patch 50 formed in the non-image area 52 of one panel 53 defined on the intermediate transfer belt 26 surface is not limited one color (one patch), but as shown in FIG. 5, plural density control patches 50, for example, density control patches 50 of yellow and magenta colors, cyan and black colors, or yellow, magenta, cyan and black colors, may be simultaneously formed in the direction crossing the moving direction of the intermediate transfer belt 26.

In this case, as shown in FIG. 2, the density sensor 48 is not one in number but is disposed as many as the number of density control patches 50 formed along the direction crossing the moving direction of the intermediate belt 26, or a density sensor 48 capable of detecting plural density control patches 50 by one sensor is used.

A non-image area 52*b* defined downstream of the image area 51 along the moving direction of the intermediate transfer belt 26 needs not be necessarily provided, and the non-image area 52*b* defined on the downstream side may not be provided.

However, depending on the perspective, the non-image area 52*b* defined downstream of the image area 51 along the moving direction of the intermediate transfer belt 26 is located, as shown in FIG. 1, upstream of the next image area 51 and therefore, the construction may be configured such that the non-image area 52*b* defined along the moving direction of the intermediate transfer belt 26 is provided on either one of the upstream side and the downstream side.

That is, in the exemplary embodiment, as shown in FIGS. 1 and 3, each of the density control patches 50Y, 50M, 50C and 50K is transferred onto the non-image region of a panel 53 defined on the intermediate transfer belt 26, but when the position at which each of the density control patches 50Y, 50M, 50C and 50K is formed on the photoreceptor drum 16 is varied according to the size of the recording sheet 35, since the photosensitive characteristics on the photoreceptor drum 16 surface are not necessarily uniform along its circumferential direction (rotation direction), the density of the density control patches 50Y, 50M, 50C and 50K is sometimes fluctuated and the image density cannot be controlled with high precision even by detecting the density of the density control patches 50Y, 50M, 50C and 50K and controlling the image density.

Figure 6:
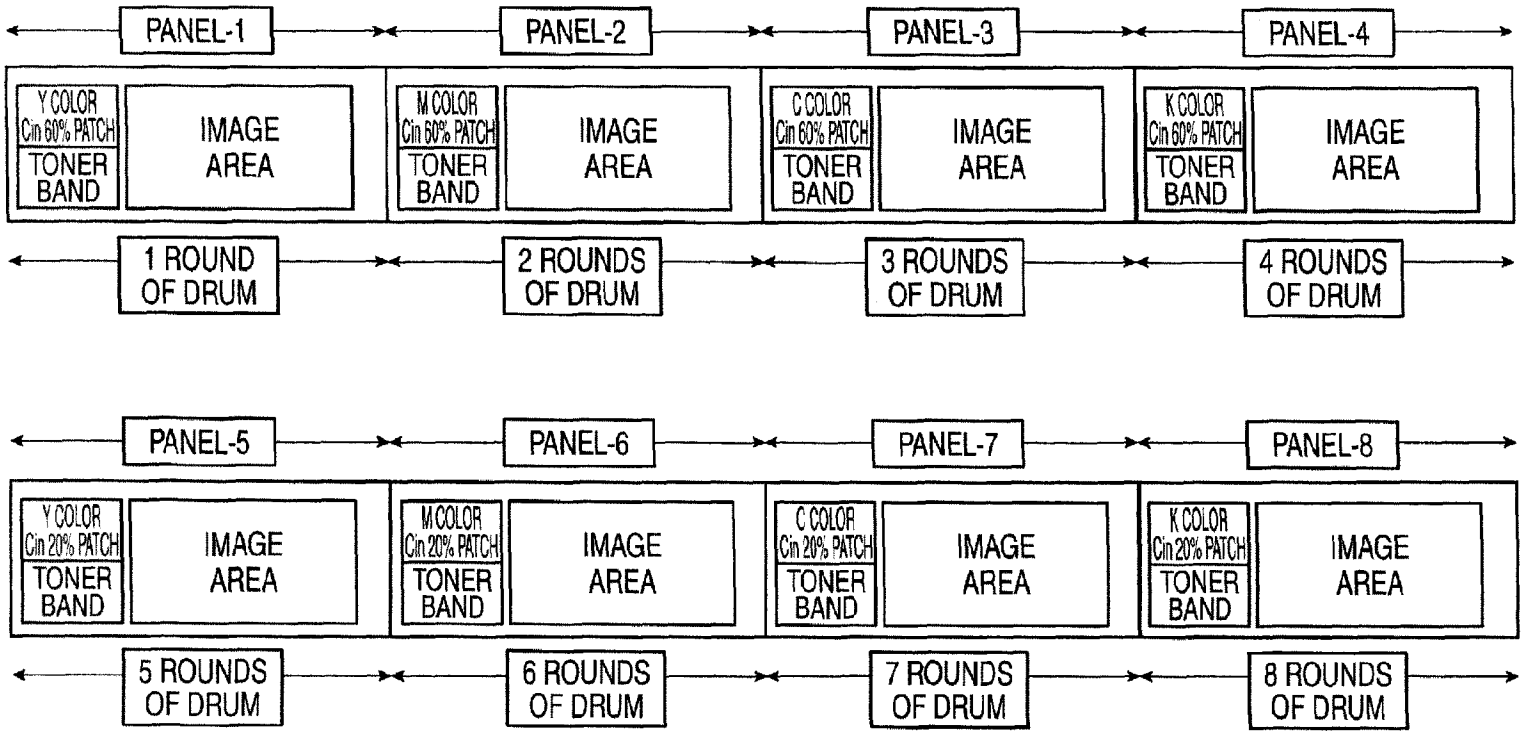
FIG. 6 RELATED ART
FIG. 6 is a configuration diagram showing locations of an image area and a non-image area on an intermediate transfer belt.
Figure 7:
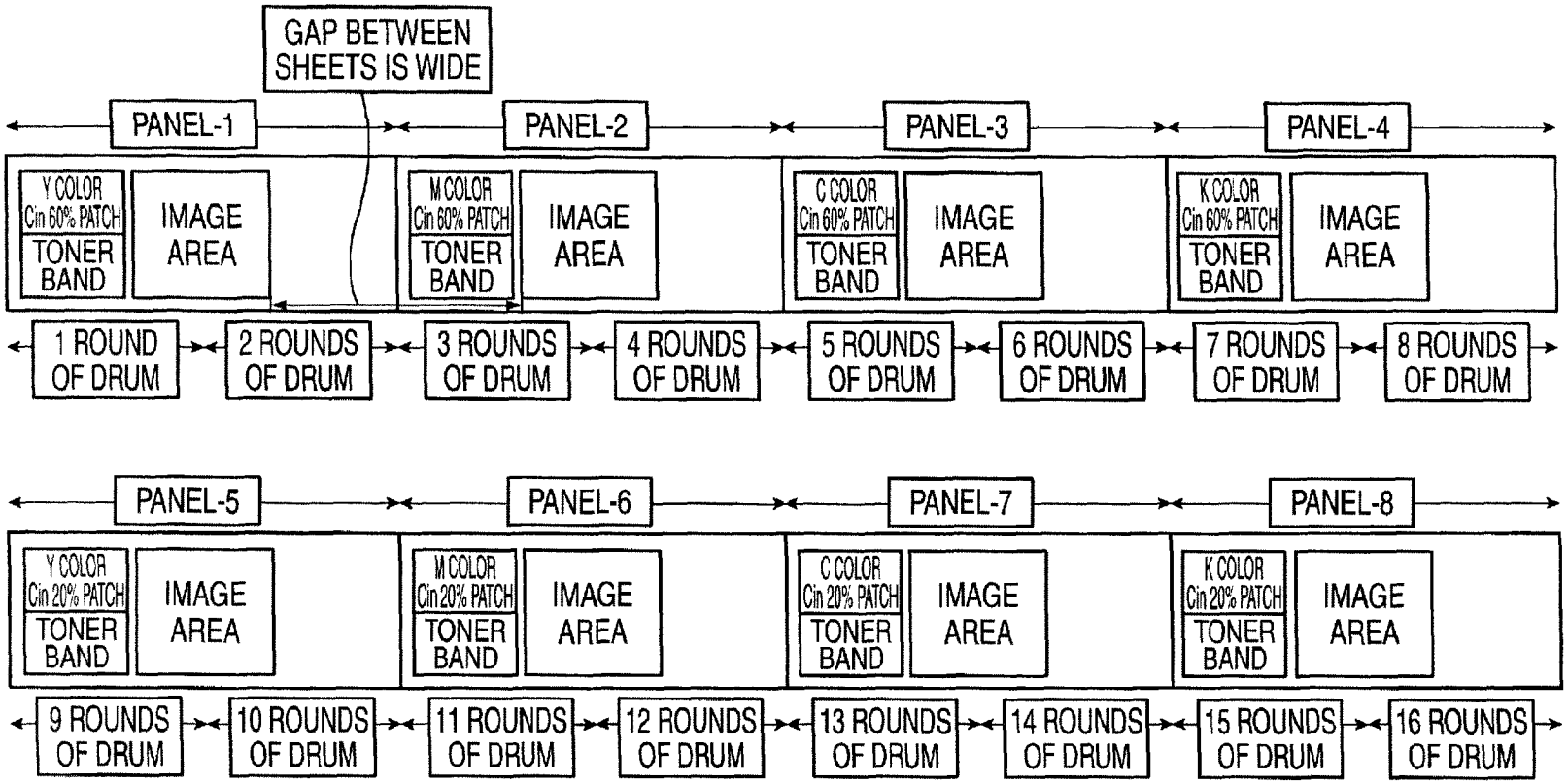
FIG. 7 RELATED ART
FIG. 7 is a configuration diagram showing locations of an image area and a non-image area on an intermediate transfer belt.

Accordingly, the exemplary embodiment is configured to always form the density control patches 50Y, 50M, 50C and 50K at the same position along the rotating direction of the photoreceptor drum 16. In this case, the density control patches 50Y, 50M, 50C and 50K formed on the photoreceptor drums 16 are, as shown in FIG. 1, primarily transferred onto the non-image areas 52 of the intermediate transfer belt 26 and detected, but since the non-image area 52 of the intermediate transfer belt 26 needs to be synchronized with the position in the rotation direction of the photoreceptor drum 16 as shown in FIG. 6 or 7, depending on the size of the recording sheet 35, a large non-image area 52 is produced on the intermediate transfer belt 26 as shown in FIG. 7, which brings about a fear of reducing the productivity that is the number of sheets printed per unit time.

To remove the fear above, in addition to the above-described configuration, the exemplary embodiment is configured to include a creation timing control unit for controlling the timing of creating the density control toner image according to the length of the recording medium along the moving direction of the intermediate transfer material so as to create the density control toner image at a position where the length becomes a least common multiple of the circumferential length of the image holding member and a value obtained by adding on the length of the recording medium along the moving direction of the intermediate transfer material to the length of the non-image region of the intermediate transfer material, which is defined between continuously conveyed recording mediums.

The expression "a least common multiple of the circumferential length of the image holding member and a value obtained by adding on the length of the recording medium along the moving direction of the intermediate transfer material to the length of the non-image region of the intermediate transfer material, which is defined between continuously conveyed recording mediums" means a smallest length out of the length obtained by integrally multiplying "a value obtained by adding on the length of the recording medium along the moving direction of the intermediate transfer material to the length of the non-image region of the intermediate transfer material, which is defined between continuously conveyed recording mediums" and the length obtained by integrally multiplying "the circumferential length of the image holding member".

More specifically, as shown in FIG. 1, in the case of an A4-size recording sheet 35 (SEF) where the longitudinal length and the transverse length are 210 mm×297 mm, the value obtained by adding on the length of the non-image area 52 to the length of the image area 51 of the recording sheet 35 is longer than the length of the photoreceptor drum 16 along the rotation direction and therefore, the length of one panel 53 defined on the intermediate transfer belt 26 is, as shown in FIG. 8, set to 1.50 times (1.50 pitch) the length of the photoreceptor drum 16 along the rotation direction. Incidentally, in the case of an A4-size recording sheet 35 (LEF), the length of the sheet in the conveying direction becomes 210 mm and therefore, as shown in FIG. 8, the panel length is set to 1.00 pitch.

Figure 9:
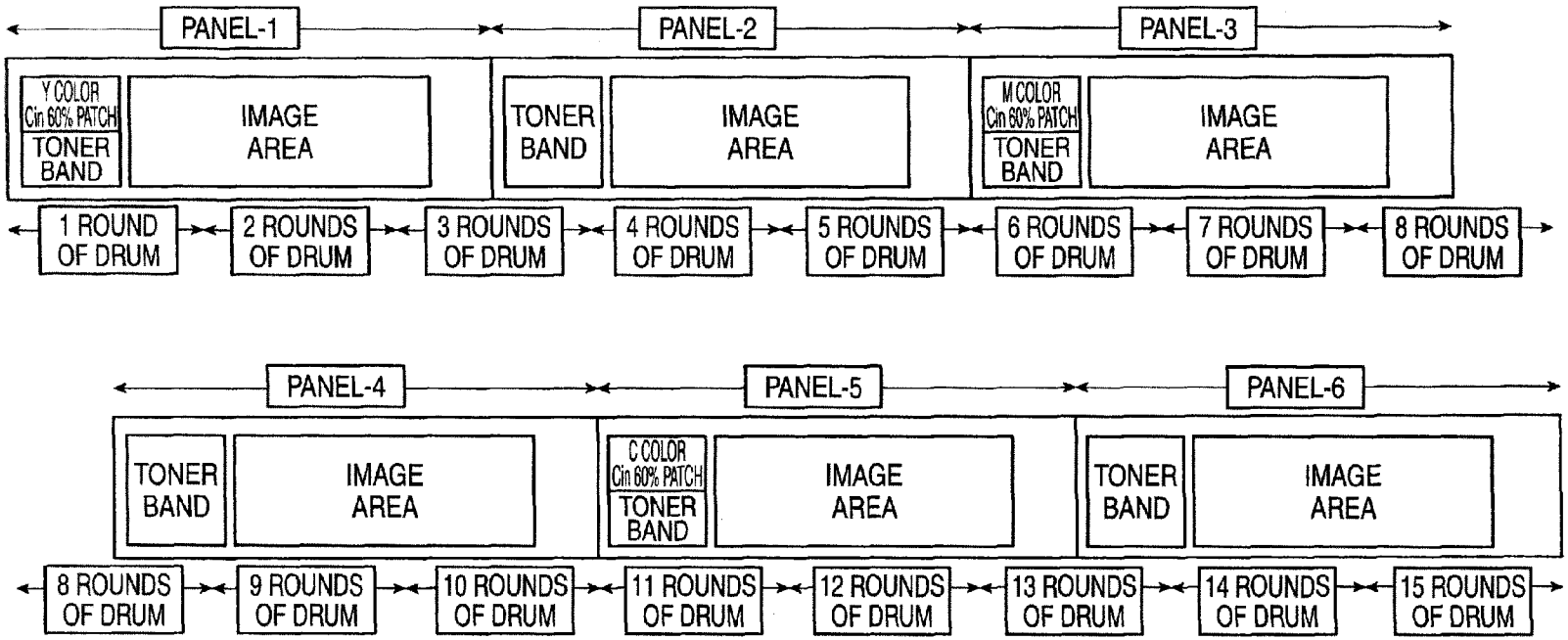
FIG. 9 is a configuration diagram showing locations of an image area and a non-image area on an intermediate transfer belt.

Also, as shown in FIG. 9, in the case of a recording sheet 35 having a large irregular size (from 482.7 to 488 mm), the value obtained by adding on the length of the non-image area 52 to the length of the image area 51 of the recording sheet 35 is longer than the length of the photoreceptor drum 16 along the rotation direction and therefore, the length of one panel 53 defined on the intermediate transfer belt 26 is, as shown in FIG. 8, set to 2.50 times (2.50 pitch) the length of the photoreceptor drum 16 along the rotation direction.

As shown in FIG. 1, in the case of an A4-size recording sheet 35 (SEF), the length from the leading end of a first panel 53 to the leading end of a third panel 53 becomes equal to 3 times the length of the photoreceptor drum 16 along the rotation direction and therefore, the exemplary embodiment is configured to form a density control patch 50Y, 50M, 50C or 50K in the non-image area 52 of the first panel 53 and the non-image area 52 of the third panel 53 and not to form a density control patch 50 in the non-image area 52 of the second panel 53.

Figure 10:
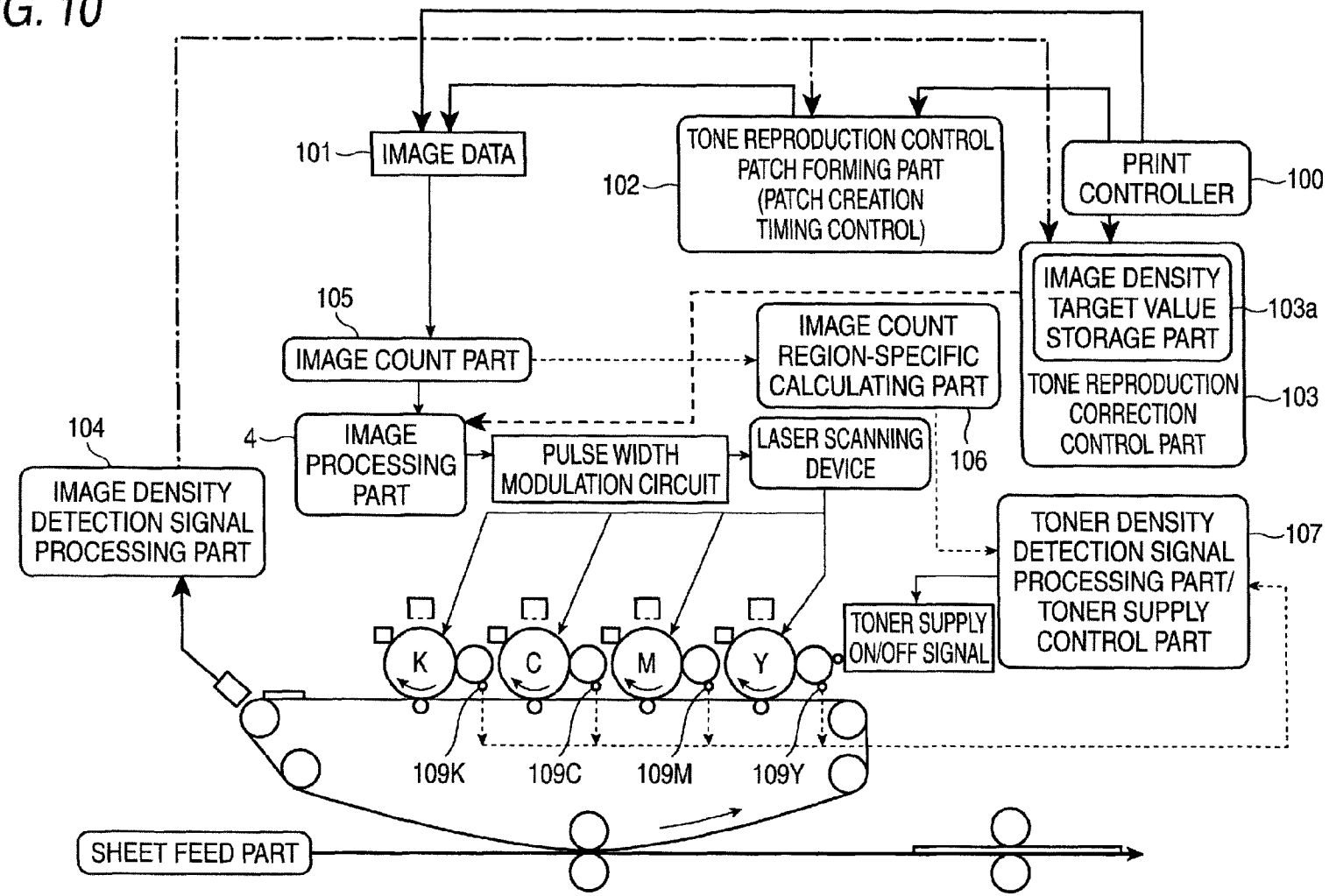
FIG. 10 is a block diagram showing a control circuit of a tandem-type full color printer as the image forming apparatus according to the exemplary embodiment 1 of the invention.

FIG. 10 is a block diagram showing, together with image forming elements, a control circuit for performing the above-described control in a color printer as the image forming apparatus according to the exemplary embodiment of the invention.

In FIG. 10, 100 indicates a print controller composed of CPU or the like for controlling the operation of the color printer, and the print controller 100 is connected to a network through an external interface (not shown) and fabricated to implement a printing operation based on an image data 101 and printing instruction issued from a host computer or the like (not shown) connected to the network. In the print controller 100, the original image data 101 or the like read by the image reading device 3 are also input.

Also, at the implement of printing operation, the print controller 100 controls the image forming units such as charging unit 17, exposure unit 15 and developing unit 18 in each of the image forming units 14Y, 14M, 14C and 14K of the image forming part 5. Furthermore, the print controller 100 controls a tone reproduction control patch forming part 102 and a tone reproduction correction control part 103, and the density measured data of the reference patches 50Y, 50M, 50C and 50K are input into these tone reproduction control patch forming part 102 and tone reproduction correction control part 103 from the density sensor 48 through an image density detection signal processing part 104.

In addition, the print controller 100 exchanges the data with the image processing part 4 and applies image processing previously determined in the image processing part 4 to the image data to be printed and at the same time, the print controller 100 is configured to fulfill the functions as an image count part 105, an image count region-specific calculating part 106 and a toner density detection signal processing part/toner supply control part 107. In the toner density detection signal processing part/toner supply control part 107, the amounts of toners to be supplied are controlled based on the values detected by toner density sensors 109Y, 109M, 109C and 109K provided on the developing devices for respective colors.

The tone reproduction control patch forming part 102 serves also as a patch creation timing control unit and from the tone reproduction control patch forming part 102, as shown in FIG. 10, the patch image data for forming an image density control patch and screen setting signals are output as the image data 101 into the image processing part 4 at a predetermined timing.

The tone reproduction correction control part 103 includes an image density target value storage part 103*a*, where according to the density detection data of the density control patches 50Y, 50M, 50C and 50K output from the density sensor 48, the amount of image exposure by an image exposure device is controlled through the image processing part 4 to become equal to the image density target value stored in the image density target value storage part 110, thereby controlling the tone reproduction correction.

Furthermore, the color printer above is configured to enable formation of a color or monochromatic image on recording sheets having various sizes or differing in the constituent material, and the information relating to the size of the recording sheet is output from a paper feeding device or output from a user interface or the like (not shown).

In this regard, the printer controller 100 is configured to control the tone reproduction control patch forming part 102 according to the size of the recording sheet so that the timing of creating an image density control patch can be controlled by the tone reproduction control patch forming part 102.

As regards the configuration above, in the full color printer according to the exemplary embodiment, at the time of transferring a density detection toner image formed on an image holding member onto a gap region defined between image transfer regions on an intermediate transfer material and allowing a density detection unit to detect the density of the density detection toner image transferred onto the intermediate transfer material, a density detection toner image can be formed at the same position on the image holding member and moreover, even when the size of the image transfer region is variously changed, it is possible to avoid unnecessarily large enlargement of the gap between the image transfer regions on the intermediate transfer material and enhance the productivity.

That is, in the color printer above, as shown in FIG. 10, at the time of printing an image, the information relating to the size of the recording sheet 35 is output from a paper feeding device 40 or from a user interface or the like (not shown) and input into the print controller 100.

The print controller 100 applies predetermined image processing to the image data 101 in the image processing part 4 and according to the image data 101 subjected to the predetermined image processing in the image processing part 4, image exposure is applied by the image exposure device 15 to the photoreceptor drum 16 of each of the image forming units 14Y, 14M, 14C and 14K.

In the full color printer above, as shown in FIG. 1, for example, when printing is continuously performed on a predetermined number of recording sheets 35 in a series of jobs, even in the middle of the printing operation, density control patches 50Y, 50M, 50C and 50K of respective colors of yellow, magenta, cyan and black are sequentially formed in the non-image area 52 located between sheets on the intermediate transfer belt 26, and the density of each density control patch 50Y, 50M, 50C or 50K of yellow, magenta, cyan or black color is detected by the density sensor 48.

The density signal of each density control patch 50Y, 50M, 50C or 50K of yellow, magenta, cyan or black color detected by the density sensor 48 is, as shown in FIG. 10, processed by the image density detection signal processing part 104 and then input into the tone reproduction control patch forming part 102 and the tone reproduction correction control part 103.

The tone reproduction correction control part 103 compares the density of each density control patch 50Y, 50M, 50C or 50K of yellow, magenta, cyan or black color with the image density target value stored in the image density target value storage part 103*a* and controls the image processing part 4 to adjust the image exposure amount or image exposure time such that the density of each density control patch 50Y, 50M, 50C or 50K of yellow, magenta, cyan or black color becomes equal to the image density target value.

As a result, in the full color printer, the image density in each of the image forming units 14Y, 14M, 14C and 14K is controlled to be equal to the image density target value, and a high-quality image can be maintained.

Here, in the full color printer, as shown in FIG. 1, the density control patches 50Y, 50M, 50C and 50K of respective colors of yellow, magenta, cyan and black are sequentially formed in the non-image area 52 of the image transfer belt 26, but the non-image area 52 of the intermediate transfer belt 26 differs depending on the size of the recording sheet 35 as shown in FIG. 1 or FIG. 9.

Figure 11:
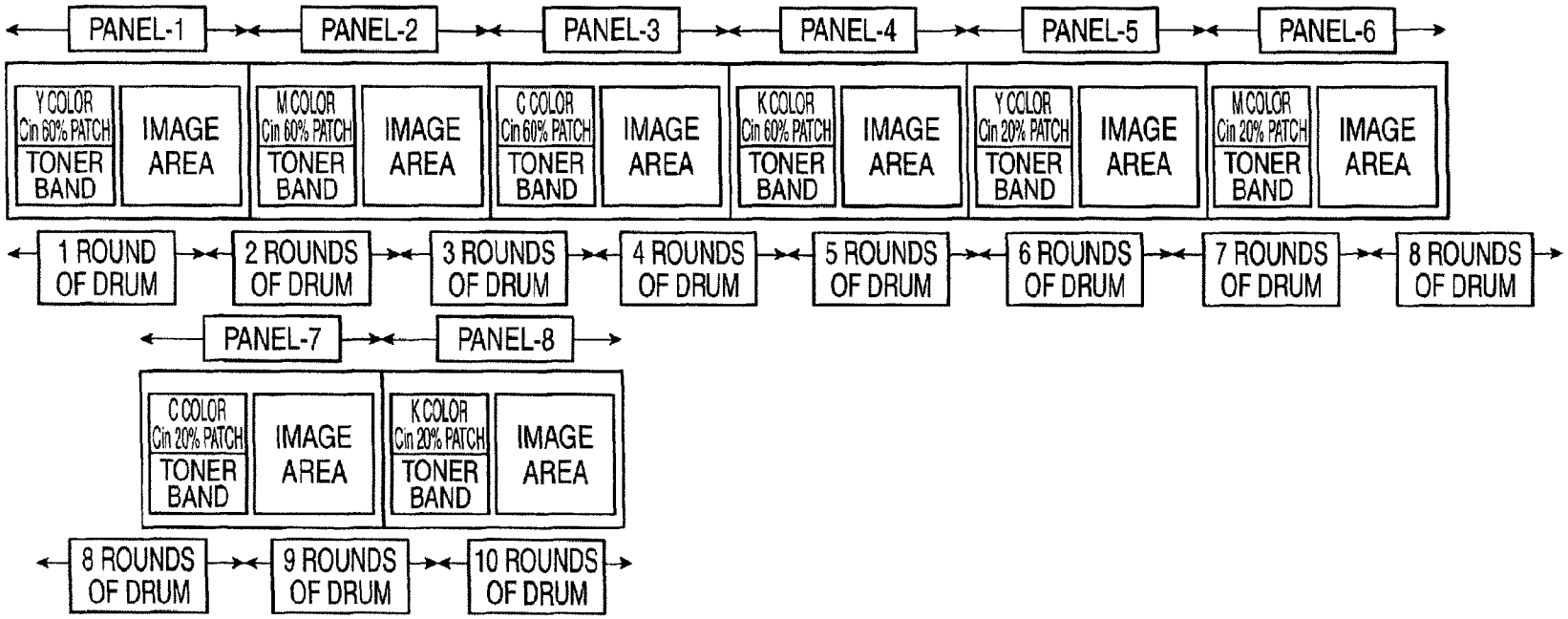
FIG. 11 RELATED ART
FIG. 11 is a configuration diagram showing locations of an image area and a non-image area on an intermediate transfer belt.

Also, in the full color printer, at the time of forming each density control patch 50Y, 50M, 50C or 50K of yellow, magenta, cyan or black color on the photoreceptor drum 16 in each of the image forming units 14Y, 14M, 14C and 14K, when the position on each photoreceptor drum 16, at which the density control patch 50Y, 50M, 50C or 50K is formed, fluctuates, as shown in FIG. 11, along the rotation direction of the photoreceptor drum 16, the photosensitive characteristics and the like of the photoreceptor drum 16 may vary.

Accordingly, the exemplary embodiment is configured to form a reference patch at the same position on each photoreceptor drum 16. The position on the photoreceptor drum 16 along the rotation direction is detected by a rotation position detecting unit such as encoder (not shown) mounted on the rotating shaft and based on the patch image data output from the tone reproduction control patch forming part 102, the density control patch 50Y, 50M, 50C or 50K is formed at the same position along the rotation direction of the photoreceptor drum 16.

In the full color printer above, as regards the size of the recording sheet 35, recording sheets of various sizes such as A5 size, A4 size, A3 size, A3 wide size slightly larger than A3 size, B5 size, B4 size, B3 size, letter size and legal size are used.

Therefore, on the intermediate transfer belt 26 where toner images of respective colors are transferred from the image forming units 14Y, 14M, 14C and 14K, as shown in FIG. 6 or FIG. 7, the image area 51 onto which an image is transferred, and the non-image areas 52 defined upstream and downstream of the image area 51 along the moving direction of the intermediate transfer belt 26 are provided in accordance with the size of the recording sheet 35.

Meanwhile, since the full color printer above is configured such that on the photoreceptor drum 16 of each of the image forming units 14Y, 14M, 14C and 14K, the density control patch 50Y, 50M, 50C or 50K is formed at the same position along the rotation direction of the photoreceptor drum, only one density control patch 50 can be formed per one rotation of the photoreceptor drum 16 and moreover, on the intermediate transfer belt onto which the density control patch 50 formed on the photoreceptor drum 16 is transferred, a non-image area 52 onto which the density control patch 50 can be transferred is provided only at a predetermined position in accordance with the size of the recording sheet 35.

This configuration has a fear that when an image area 51 for forming an image on one recording sheet 35 and non-image areas 52 located before and after the image area are defined on the intermediate transfer belt 26 such that, as shown in FIG. 7, the length in total of those parts always becomes an integral multiple of the circumferential length of the photoreceptor drum 16, the gap between sheets 35 is unnecessarily broadened and the productivity is greatly reduced.

To eliminate the fear above, in the exemplary embodiment, the size of the panel 53 is not set such that the length in total of an image area 51 for forming an image on one recording sheet 35 and non-image areas 52 located before and after the image area always becomes an integral multiple of the circumferential length of the photoreceptor drum 16 but is set such that, as shown in FIG. 1, the density control patches 50Y, 50M, 50C and 50K are created only at a position of the least common multiple distance where the integral multiple of a value obtained by adding on the lengths 52*a* and 52*b* of non-image areas 52 on the intermediate transfer belt 26 to the length L of an image area 51 corresponding to the recording sheet 35 along the moving direction of the intermediate transfer belt 26 becomes an integral multiple of the circumferential length of the photoreceptor drum 16, while not creating the density control patches 50Y, 50M, 50C and 50K in other non-image areas 52 on the intermediate transfer belt 26.

Accordingly, the size of the panel 53 needs not be set to become an integral multiple of the circumferential length of the photoreceptor drum 16, and the size of the panel 53 can be set not to define an unnecessarily large non-image area 52 on the intermediate transfer belt 26, for example, may be set to 1.5 times, 2.5 times or 1.25 times, the circumferential length of the photoreceptor drum 16, so that reduction of the productivity can be avoided while maintaining the detection precision for the density control patches 50Y, 50M, 50C and 50K and in turn, the productivity can be enhanced.

INDUSTRIAL APPLICABILITY

The invention can be applied to an image forming apparatus employing an electrophotographic system, such as printer, copying machine and facsimile.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image holding members on which toner images of colors different from each other are formed;

an intermediate transfer material onto which the toner images of respective colors formed on the plurality of image holding members are transferred;

a transfer unit that transfers the toner images of respective colors transferred on the intermediate transfer material, onto a recording medium;

a density control toner image creating unit that creates a density control toner image at a constant position on each of the image holding members;

a density detection unit that detects density of the density control toner image formed on each of the image holding members by the density control toner image creating unit and then transferred onto a non-image region defined between adjacent image regions along a moving direction of the intermediate transfer material, a length obtained by adding the non-image region to the image region along the moving direction of the intermediate transfer material being different from a length obtained by integrally multiplying a circumferential length of the image holding member;

a density control unit for the density control toner image, that controls the density of the density control toner image to be formed in another non-image region of the intermediate transfer material in accordance with the density information of the density control toner image detected by the density detection unit; and a creation timing control unit that controls timing of creating the density control toner image to create the density control toner image in the non-image region of the intermediate transfer material at a position where a length obtained by integrally multiplying the length obtained by adding the non-image region to the image region along the moving direction of the intermediate transfer material becomes equal to a length obtained by integrally multiplying the circumferential length of the image holding member.

2. The image forming apparatus as claimed in claim 1, wherein the creation timing control unit determines the length of the non-image region along the moving direction of the intermediate transfer material in accordance with a length of the recording medium along the moving direction of the intermediate transfer material.

3. The image forming apparatus as claimed in claim 1, wherein the creation timing control unit creates a toner band for toner ejection in a portion of the non-image region in which the density control toner image is not created.

4. The image forming apparatus as claimed in claim 1, wherein when the density control toner image cannot be created at the creation timing prepared by the creation timing control unit, the creation timing control unit makes a change to create the density control toner image at the next creation timing and the next creation timing is at a position separated from the creating timing by a distance equal to the length obtained by integrally multiplying the circumferential length of the image holding member.

5. The image forming apparatus as claimed in claim 1, further comprising:

a sheet conveying unit that continuously conveys a plurality of kinds of recording mediums differing in the size along the moving direction of the intermediate transfer material.

* * * * *